US010059508B2

(12) United States Patent
Flint et al.

(10) Patent No.: US 10,059,508 B2
(45) Date of Patent: Aug. 28, 2018

(54) SELF-COLLAPSING STACKABLE INTERMODAL SHIPPING CONTAINER

(71) Applicants: John L. Flint, Merritt Island, FL (US); Yolande C. Hauser, Cincinnati, OH (US); Donald W. Streck, Ft. Thomas, KY (US)

(72) Inventors: John L. Flint, Merritt Island, FL (US); Yolande C. Hauser, Cincinnati, OH (US); Donald W. Streck, Ft. Thomas, KY (US)

( * ) Notice: Subject to any disclaimer, the term of this patent is extended or adjusted under 35 U.S.C. 154(b) by 60 days.

(21) Appl. No.: 15/100,161

(22) PCT Filed: Jun. 17, 2014

(86) PCT No.: PCT/US2014/000147
§ 371 (c)(1),
(2) Date: May 27, 2016

(87) PCT Pub. No.: WO2015/195069
PCT Pub. Date: Dec. 23, 2015

(65) Prior Publication Data
US 2017/0021998 A1 Jan. 26, 2017

(51) Int. Cl.
*B65D 88/12* (2006.01)
*B65D 88/52* (2006.01)
*B65D 88/02* (2006.01)

(52) U.S. Cl.
CPC ..... *B65D 88/52* (2013.01); *B65D 88/022* (2013.01); *B65D 88/121* (2013.01)

(58) Field of Classification Search
CPC ..... B65D 90/02; B65D 90/20; B65D 90/008; B65D 90/18; B65D 88/52; B65D 88/022; B65D 88/121; B65D 88/128; B65D 11/18; B65D 21/068
USPC ..... 296/26.04; 220/1.5, 6, 4.28, 8, 9.2
See application file for complete search history.

(56) References Cited

FOREIGN PATENT DOCUMENTS

WO WO2010085785 * 7/2010 ..... B65D 88/121

* cited by examiner

*Primary Examiner* — J. Gregory Pickett
*Assistant Examiner* — Elizabeth Volz
(74) *Attorney, Agent, or Firm* — Wm. Cates Rambo

(57) ABSTRACT

The collapsible shipping container (10) may comprise a base (12), a roof (14), a pair of side walls (16), a pair of end walls (18), four telescoping corner columns (20), and means such as air jacks (21) and or scissors devices (52) for elevating and lowering the roof, side walls and corner columns. Each of the end walls (18) may be movable between up and down positions, each of the side walls (16) may be formed with a plurality of longitudinally extending, overlapping panels, and the means for elevating and lowering the roof, side walls and corner columns may be operative with the end walls (18) in their down positions.

20 Claims, 8 Drawing Sheets

SELF-COLLAPSING STACKABLE INTERMODAL SHIPPING CONTAINER

TECHNICAL FIELD

The exemplary embodiment relates to intermodal shipping containers, and more particularly to those which may be stacked and shipped together in a collapsed state when empty.

BACKGROUND ART

Intermodal shipping containers house enormous quantities of finished goods moving by ship, rail and truck. They protect the goods during transport and in storage, so that the conveyance or storage site may be unencumbered of that function. The shipping industry was transformed when the first steel containers appeared in the 1950s. A subsequent improvement, the "Twist Lock" device by which the containers were secured together and to the conveyance, helped place these structures in common use.

As intermodal container traffic grew over the past 50 years, the logistics and expense of storing and moving empty containers increased. It is believed that significant trade imbalances created the surplus, with an estimated one-third of all containers being empty, at any given time. The cost of relocating empty containers for revenue service was so high that shippers attempted to avoid it. The result has been shipping yards, ports and intermodal facilities overflowing with empty containers. The environment was damaged by this overflow, and the energy required to move empty containers has added to the atmospheric carbon load. It is estimated today that over 34 billion dollars a year is spent annually on repositioning empty containers around the world. This cost is ultimately passed onto the end users and is reflected in the cost of each product moved.

Attempts to fabricate collapsible containers have been made. However, these earlier designs required external equipment that was cost prohibitive or unavailable in smaller ports, railroad yards and trucking facilities.

SUMMARY OF THE INVENTION

A collapsible shipping container may comprise a base, a roof, a pair of sidewalls, a pair of end walls, four or more telescoping corner columns, and means for elevating and lowering the roof, side walls and corner columns. Each of the end walls may be movable between up and down positions. Each side wall may be formed from a plurality of longitudinally extending, overlapping panels that are vertically slidable against one another. The telescoping corner columns, roof and side walls may be raised and lowered when the end walls are in down positions.

DETAILED DESCRIPTION OF THE EXEMPLARY EMBODIMENT

Figure 1:
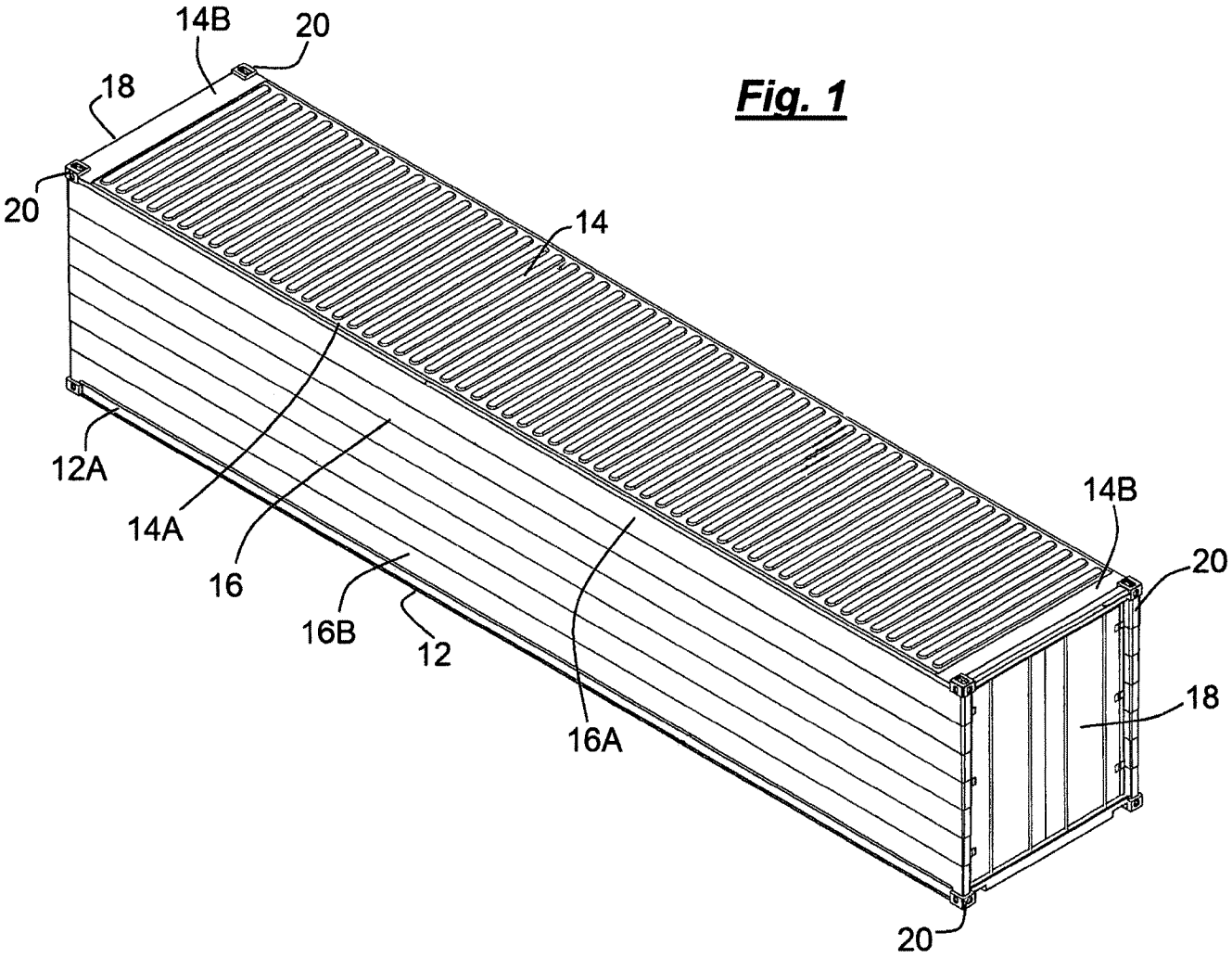
FIG. 1 is an isometric view of the container in a cargo-receiving elevated state.

As illustrated in FIGS. 1-6, a collapsible shipping container 10 may comprise a base 12, a roof 14, a pair of side walls 16, a pair of end walls 18, and four telescoping corner columns 20. Each of the end walls 18 may be pivoted between elevated and lowered positions. Each side wall 16 may be formed from a plurality of longitudinally extending, overlapping panels that are vertically slidable against one another. The telescoping corner columns 20, the roof 14 and the side walls 16 may be raised and lowered when the end walls 18 are in lowered positions.

Figure 6:
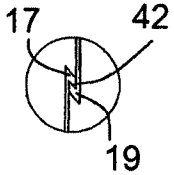
FIG. 6 is an enlarged view of a joint between the two panels of the elevated side wall.
Figure 4:
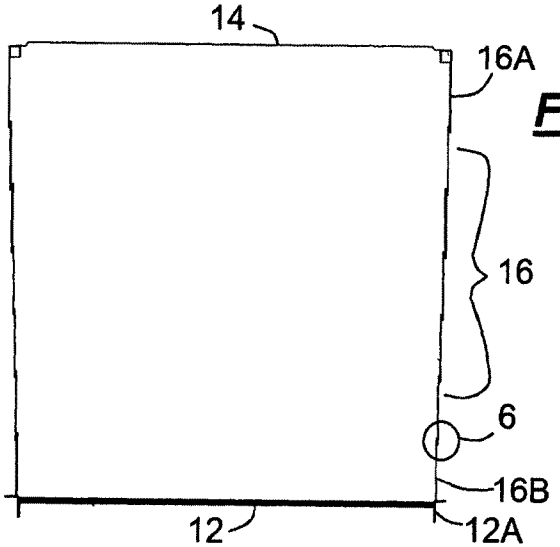
FIG. 4 is a diagrammatic view of the side walls elevated on the container.

An uppermost side wall panel 16A may be connected to a longitudinally extending roof frame member 14A, and a lowermost side wall panel 16B may be connected to a longitudinally extending base frame member 12A. As illustrated in FIG. 6, each panel may be formed with an upper down-turned edge 17 and a lower up-turned edge 19. When the roof is being elevated, the lower edge 19 of one panel engages the upper edge of the panel below it and pulls it up. The side wall panels and the roof may be formed from steel, polymer, glass fiber, carbon fiber, aluminum, alloys or carbon fiber reinforced polymer materials. A full length and width, polymer based moisture barrier that will fold and extend in conjunction with the collapsing and erecting of the container may be provided.

Figure 2:
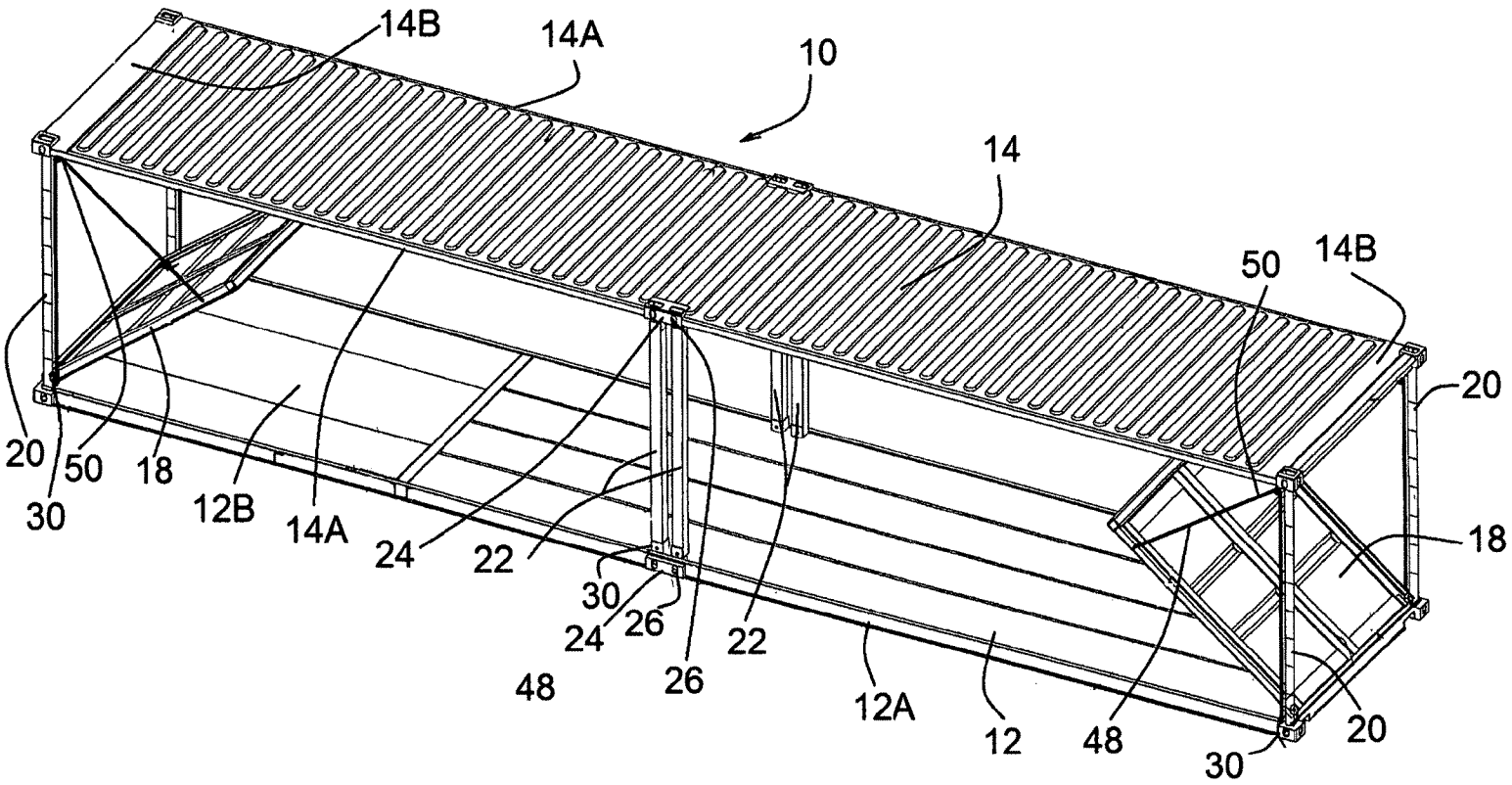
FIG. 2 is a view similar to FIG. 1, with the sidewalls not shown and the end walls partially lowered.

As shown in FIG. 2, intermediate posts 22 may be hinged at the base frame member 12A and locked into receiving elements 24 on the base and roof frame members with pins 26.

Figure 3:
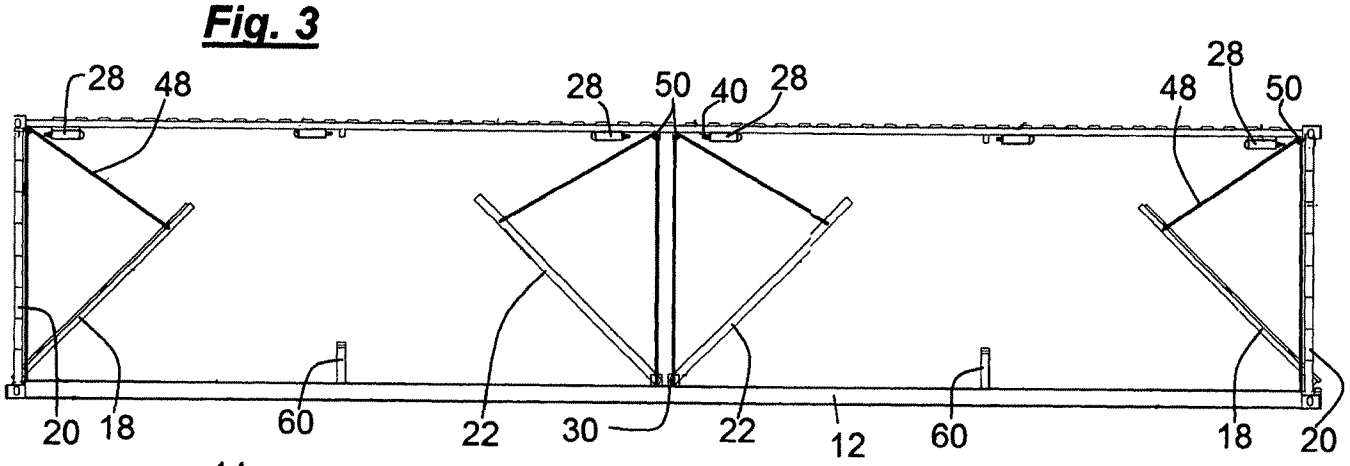
FIG. 3 is an elevational view similar to FIG. 2 with the central support columns and end walls partially lowered.
Figure 5:
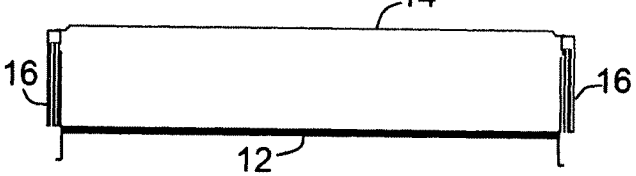
FIG. 5 is a diagrammatic view of the sidewalls lowered on the container.

As shown in FIG. 3, electrically and/or mechanically actuated locking mechanisms 28 may be mounted on the longitudinal roof frame members for releasably engaging the intermediate posts 22 and the end walls 18 to secure them in raised positions. The locking pins 28 may be actuated manually, electrically or by air or hydraulic power.

Figure 7:
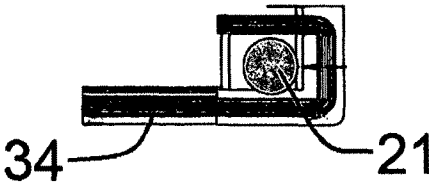
FIG. 7 is a diagrammatic view of supply lines and an air jack for moving a telescoping corner member.
Figure 11:
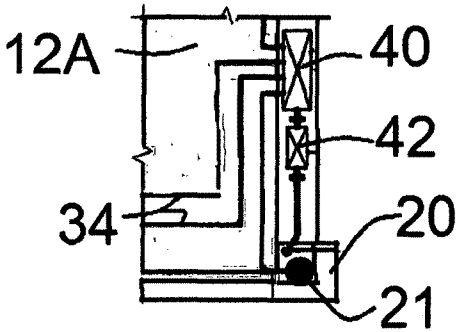
FIG. 11 is an enlarged view of the components that activate on the telescoping corner columns.
Figure 9:
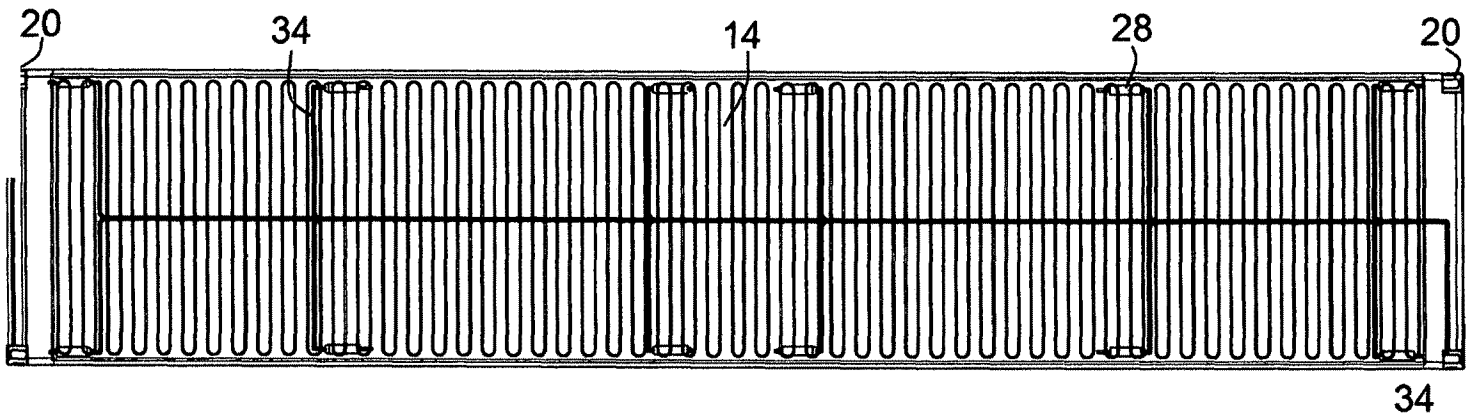
FIG. 9 is a plan view of supply lines for activating the roof mounted locking mechanisms.
Figure 10:
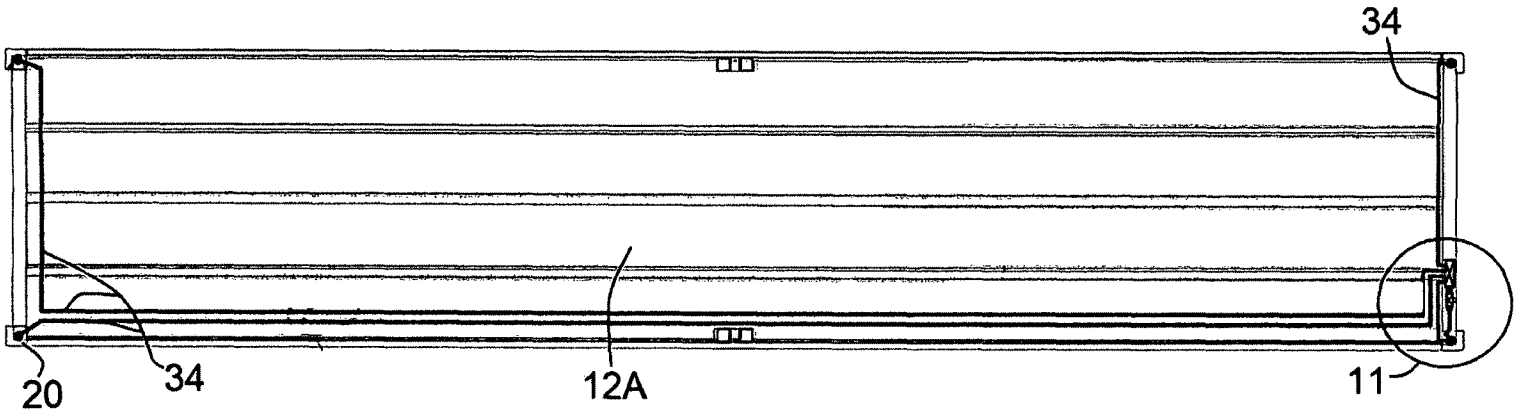
FIG. 10 is a plan view of supply lines for activating the floor mounted telescoping corner columns.
Figure 12:
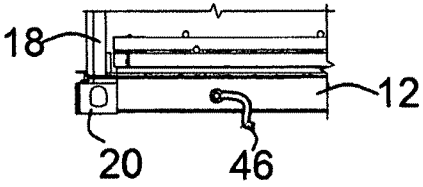
FIG. 12 is a fragmentary view of a connector extending from the base for an external power supply.

Electrically, pneumatically, hydraulically and/or mechanically actuated devices may control the collapse/erect operations. As illustrated in FIGS. 9 and 10, a plurality of flexible electrical and/or hydraulic lines 34 may be mounted on the base and roof frame members and extend between the telescoping columns 20 and the locking mechanisms 28. As shown in FIG. 11, the hydraulic and/or pneumatic lines may connect to a manifold 40 to balance the hydraulic pressure between the operative devices. As shown in FIG. 12, one or more coupling devices 46 may be integrated into the base frame 12 for connecting the control devices to external power sources. As shown in FIGS. 7 and 11, each of the telescoping columns 20 may be equipped with an air jack 21 by which the columns, the side walls 16 and the roof 14 are raised and lowered.

Figure 8:
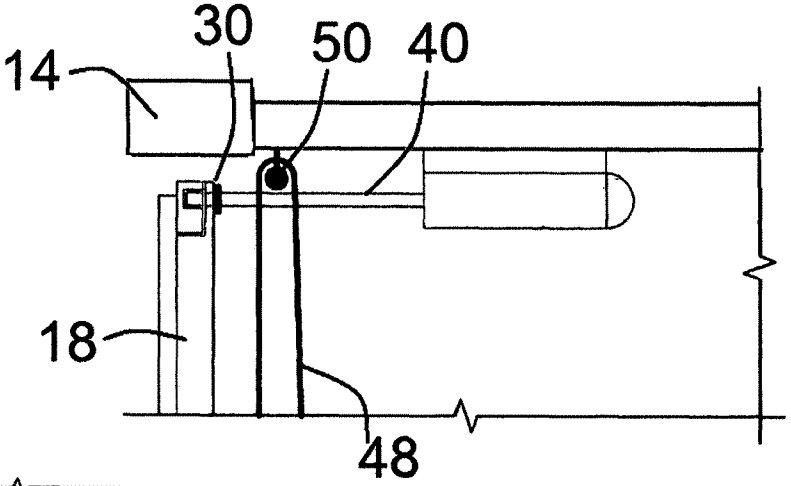
FIG. 8 is a diagrammatic view of a locking mechanism and a pulley assembly for an end wall.

As illustrated in FIGS. 2, 3 and 8, end wall position control devices may include cables 48 and pulleys 50 whereby the end walls 18 are lowered to rest on the container base 12 and elevated to abut with the roof 14 and corner columns 20.

Figure 15:
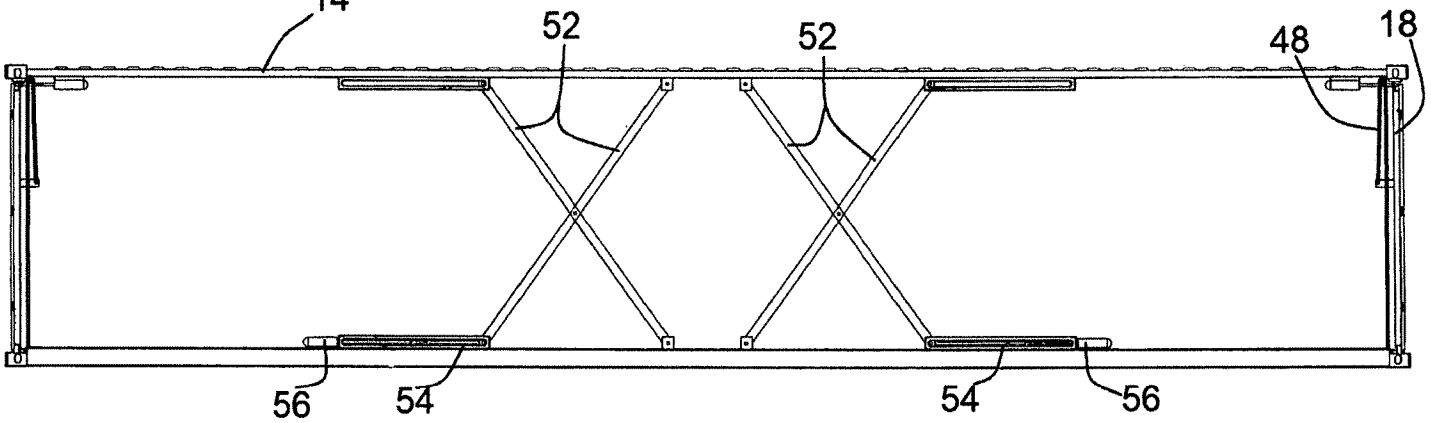
FIG. 15 is a side view of the elevated container without sidewalls and particularly illustrates scissors-type devices for raising and lowering the container.
Figure 16:
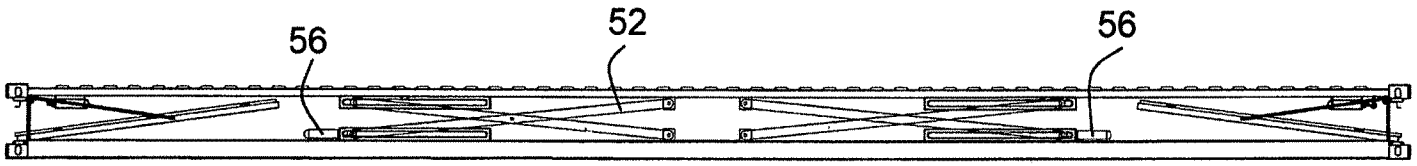
FIG. 16 is a side view of the lowered container illustrating the scissors-type devices.

As illustrated in FIGS. 15 and 16, x-frame scissors devices 52 may be installed parallel to the sidewalls and pinned to the roof and floor assemblies. The scissors devices 52 may serve in place of or in addition to the air jacks 21 to raise and lower the telescoping columns 20, the side walls 16 and the roof 14. A horizontally placed screw device 54 may be attached to the pinned connection of one lower corner of the x-frame and when activated, may raise and lower the roof, side walls and corner columns of the container as the scissors devices translate along the screw device. A horizontally placed air cylinder device 56 may be attached to the pinned connection of one lower corner of the x-frame.

Figure 18:
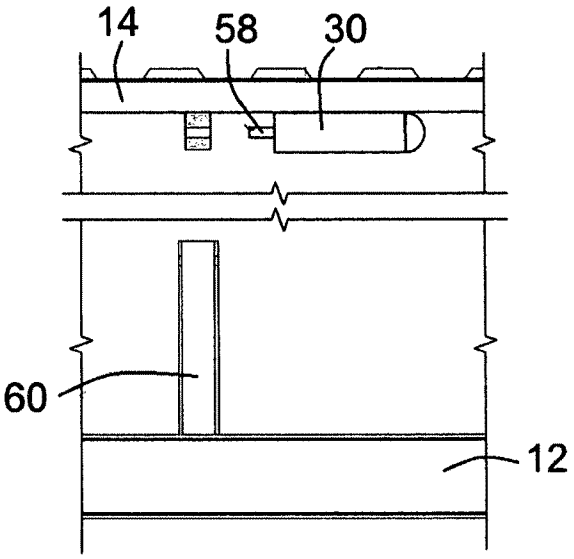
FIG. 18 is a diagrammatic view of the locking mechanism of FIG. 17 with the container in an elevated position.
Figure 17:
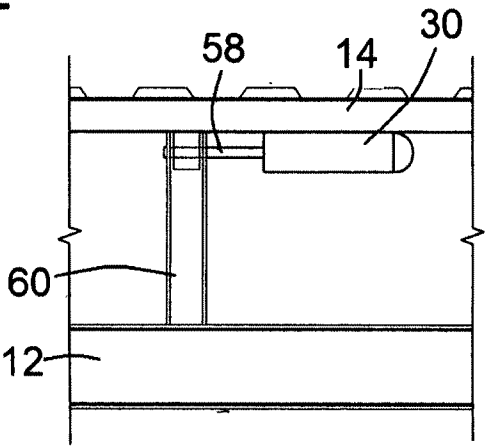
FIG. 17 is a diagrammatic view of a locking mechanism securing the container in a lowered position.

As illustrated in FIGS. 17 and 18, a series of hydraulically or pneumatically actuated cylinder and pin assemblies 58 may be disposed below the roof 14 to engage a strut projecting upwardly from the base 12 when the roof 14 has been lowered. Upon engagement, the container may be lifted and repositioned in its collapsed state.

Figure 13:
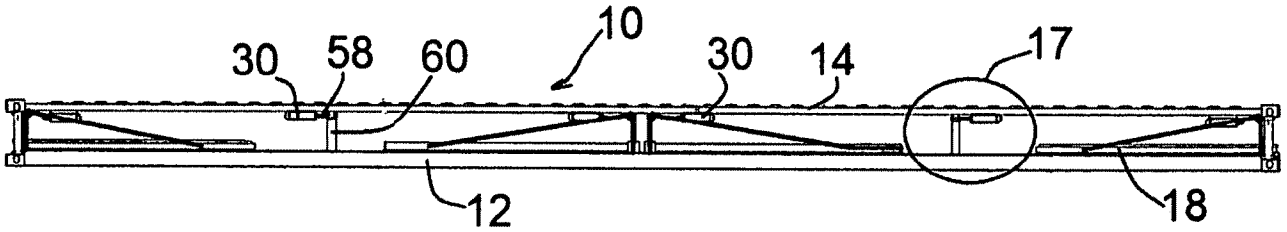
FIG. 13 is a side view of a lowered container without the sidewalls.
Figure 14:
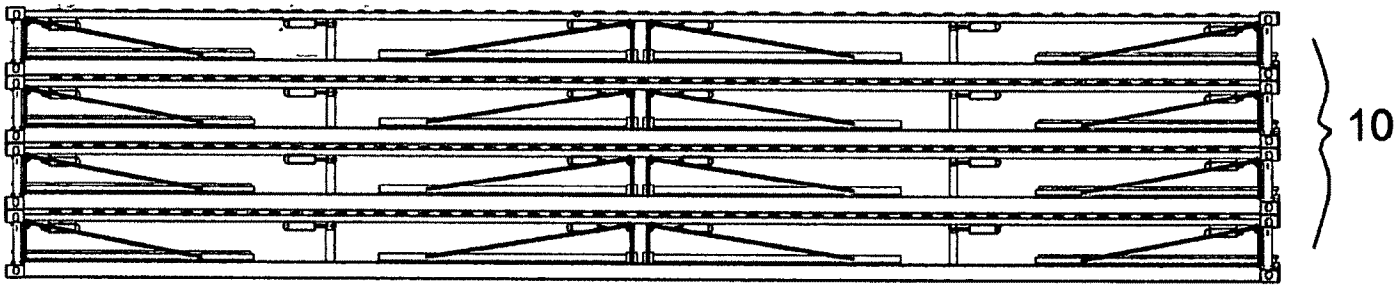
FIG. 14 is a side view of four lowered containers stacked together.

As illustrated in FIGS. 13 and 14, the collapsed container may be stacked in place with three additional collapsed containers. The four stacked containers may be placed on top of each other, and connected at the corners. The four stacked containers can be lifted and repositioned as one unit. The self-collapsing, stackable shipping container may be raised and lowered in a vertical manner, using only self-contained elements. By introducing a means to collapse up to four empty containers into the space of a single standard shipping container, all modes of shipping become more cost efficient, more environmentally friendly and more sustainable in their use.

Further, by connecting four collapsed containers to each other using standard methods, efficiencies and cost savings are realized in shipping yards where three out of four picks of empty containers are eliminated. This design allows for the shipyards, trucking terminals, and other multiple handlers of the intermodal containers to interact with the existing fleet of 18,000,000 containers currently in use worldwide. This design will connect to an existing steel container utilizing the standard twist lock mechanism globally in use today. Depending on availability of empties, one or more containers of this design can be stacked and secured between existing non-collapsible containers currently in use today.

The self-collapsing container may use commonly available sources of energy—electricity, air, hydraulics—to collapse and erect the empty container. One person may complete the task of preparing the container for collapse, with only a few small hand tools. It is contemplated that the art associated with hinged elements, sliding parts and locking devices that allow deployment of the erecting/collapsing mechanisms with only the "flip of a switch" may be employed. Internal devices, connected to an external energy supply, may raise and lower the container roof and sidewalls; as well as lower the end-walls and intermediate struts, thereby allowing the container to be reduced in volume to occupy ⅓ to ¼ of the volume of a full container.

The container collapsing mechanism may avoid impacting two of the most critical structural elements—the floor system and the roof system of the container. The container can be collapsed and erected using only externally supplied energy or power sources.

It is further contemplated that the self-collapsing container may be water-tight. The previously mentioned vapor or moisture barrier would assure that the products being transported would remain dry during transport.

The container may be fabricated using a variety of materials; steel, aluminum, alloys, glass fiber, composites, polymers, resins or composites thereof; providing benefits for scanning, x-ray and other homeland security measures. The container can be fabricated using a combination of the above materials. Alternatively, it may be constructed completely from polymer based materials.

The container may be equipped with global positioning devices, RFID tags, bar codes or other means of tracking, monitoring and identifying the device and its contents.

Each container may be equipped with conventional twist-lock casting devices that enable the containers to be interconnected and/or attached to platforms, flatbed trailers and intermodal rail cars.

The container may be designed so that the combined weight of four collapsed containers, occupying the same volume as a fully erect container, may have a total weight less than or equal to the gross weight of the full container. This allows a group of up to four containers to be stacked together, interlocked and moved as one unit.

The self-collapsing container may be modular so that a 20 ft. container design can be expanded to a 40 ft. container, or a 53 ft. intermodal or domestic shipping container. Likewise, a standard size shipping container (8 ft.-6 in. high) can be applied equally well to the high cube type (9 ft.-6 in.) container.

The self-collapsing container may be designed to be handled by all current conventional handling equipment, from the top or the bottom.

The self-collapsing, stackable container may be built to meet all current design, testing and acceptance standards of the industry.

This invention may retain crucial existing elements of the established shipping container industry by matching existing carrier frame dimensions; utilizing existing means of connecting containers (referred to as twist-lock devices) in their corners; and retaining fork lift pocket locations and dimensions.

It may reduce empty container volumes by using a vertical collapse/expand mechanism wherein the sidewall panels pass by each other as the roof is lowered or raised. The machinery may be self-contained within the shipping container. In this form, the vertically collapsing container does not require the use of heavy equipment to raise and lower it.

It may use air (or electric) power readily available to all modes of container transport. It has the ability to be expanded to include self-actuated devices that literally allow and operator to throw a switch to raise and lower the container. OSHA safety/warning alarms, if required, would allow the field operator to collapse and or erect the container more safely.

Through the use of telescoping sidewalls and hinged non-telescoping structural elements, it is able to meet existing structural and durability standards.

The present invention utilizes a telescoping concept for the raising and lowering of the container roof. Sidewalls are sectioned into panels to allow overlapping elements to slide past each other as the supporting structure is lowered. The overlapping panels engage each other, creating a watertight seal between panels as the container is erected.

End walls are self-contained frames, sealed against the frame of the sidewalls, and hinged at the lower inside corner to allow the wall frames to be lowered to lay flat on the floor of the container in the collapsed position. Once the end wall pins are disengaged, springs move the end walls out of plumb and the supporting cables carry the weight of the end wall to its lowered position, eliminating the need for extensive personnel or equipment to achieve the raised or lowered position.

As the roof and sidewalls are raised into the fully erect position, cable systems raise the end walls to the erect position. When the container and end walls are fully erect; air or electric activated pins seat the supporting structure into a locked position. Alternatively, one person can engage me locking pins, assuring the end wall is in its final position and locked.

Supplementary full height posts can be installed at midpoint or intermediate locations for added structural strength or redundancy, and to fully engage the sidewalls of the structure in its erect transportable position.

The invention claimed is:

1. A collapsible intermodal shipping container comprising a base, a roof, a pair of side walls, a pair of end walls, four telescoping corner columns, and means for elevating and lowering said roof, side walls and corner columns a distance of at least one-half of the elevated height of said container; each of said end walls being movable between up and down positions, each of said side walls being formed with a plurality of longitudinally extending, overlapping panels movable in relatively aligned vertical planes between up and down positions, and said means for elevating and lowering said roof, side walls and corner columns being operative with the end walls in their down positions.

2. The collapsible intermodal shipping container of claim 1, wherein the means for elevating and lowering said roof, side walls and corner columns are operatively connected to the four telescoping corner columns.

3. The collapsible intermodal shipping container of claim 2, wherein the means for elevating and lowering said roof, side walls and corner columns comprise an air jack disposed within each of said corner columns.

4. The collapsible intermodal shipping container of claim 3, wherein at least one air supply line is connected to each of the air jacks in the telescoping corner columns.

5. The collapsible intermodal shipping container of claim 4, wherein an air manifold is connected to said at least one supply line.

6. The collapsible intermodal shipping container of claim 5, wherein pneumatic coupling means are provided to connect the manifold to an external power source.

7. The collapsible intermodal shipping container of claim 6, wherein the pneumatic coupling means are mounted on the base.

8. The collapsible intermodal shipping container of claim 6, wherein the external power source is pneumatic.

9. The collapsible intermodal shipping container of claim 1, and further comprising at least two intermediate support members movable between up and down positions, said means for elevating and lowering said roof, side walls and corner columns being operative on the intermediate support members.

10. The collapsible intermodal shipping container of claim 1, wherein the longitudinally extending, overlapping panels of the side walls are vertically slidable against one another as they are raised and lowered.

11. The collapsible intermodal shipping container of claim 1, wherein a first set of locking mechanisms are mounted on the roof, said locking mechanisms being disposed to releasably hold the end walls in their up positions.

12. The collapsible intermodal shipping container of claim 11, wherein each of said first set of locking mechanisms includes a pin movable by means of at least one of a group comprising manual, electrical and pneumatic mechanisms.

13. The collapsible intermodal shipping container of claim 1, wherein the roof and the overlapping panels of the side walls are composed of at least one of a group comprising steel, polymeric resin, glass fiber, carbon fiber, and aluminum alloy.

14. The collapsible intermodal shipping container of claim 1, wherein a cable is connected to each of the end walls and is disposed on the container to move said end wall between the up and down positions.

15. The collapsible intermodal shipping container of claim 1, wherein the means for elevating and lowering the roof, side walls and corner columns comprises an x-framed scissors assembly.

16. The collapsible intermodal shipping container of claim 15, wherein the x-framed scissors assembly is equipped with a horizontally placed screw device for moving said scissors assembly between up and down positions.

17. The collapsible intermodal shipping container of claim 1, wherein a second set of locking pins are mounted on the container adjacent to the corner columns, said second set of locking pins being disposed to engage said corner columns and to hold said corner columns, sidewalls and roof in their lowered positions.

18. The collapsible intermodal shipping container of claim 1, and further comprising means for connecting at least two of said containers together with their sidewalls, roof and corner columns lowered.

19. The collapsible intermodal shipping container of claim 18, wherein said means for connecting at least two of said containers enables said containers to be moved as a unit.

20. The collapsible intermodal shipping container of claim 1, wherein all of the means for elevating and lowering said roof, side walls and corner columns except an external power source are housed within said container.

* * * * *